US006952927B2

(12) United States Patent
Howell et al.

(10) Patent No.: US 6,952,927 B2
(45) Date of Patent: Oct. 11, 2005

(54) MULTIPORT DOME BAFFLE

(75) Inventors: Stephen John Howell, West Newbury, MA (US); John Carl Jacobson, Melrose, MA (US); Timothy Patrick McCaffrey, Swampscott, MA (US); Barry Francis Barnes, Milford, CT (US); Thet Don Kwan, Peabody, MA (US)

(73) Assignee: General Electric Company, Schenectady, NY (US)

( * ) Notice: Subject to any disclaimer, the term of this patent is extended or adjusted under 35 U.S.C. 154(b) by 161 days.

(21) Appl. No.: 10/447,885

(22) Filed: May 29, 2003

(65) Prior Publication Data

US 2004/0237532 A1 Dec. 2, 2004

(51) Int. Cl.[7] ..... F23R 3/50
(52) U.S. Cl. ..... 60/798; 60/804
(58) Field of Search ..... 60/748, 756, 722, 60/804, 786, 798

(56) References Cited

U.S. PATENT DOCUMENTS

| | | | | |
|---|---|---|---|---|
| 3,720,058 A | | 3/1973 | Collinson et al. | |
| 3,750,397 A | | 8/1973 | Cohen et al. | |
| 4,194,358 A | | 3/1980 | Stenger | |
| 4,222,230 A | | 9/1980 | Bobo et al. | |
| 4,525,996 A | * | 7/1985 | Wright et al. | 60/796 |
| 4,584,834 A | | 4/1986 | Koshoffer et al. | |
| 4,689,961 A | | 9/1987 | Stratton | |
| 4,843,825 A | | 7/1989 | Clark | |
| 5,117,637 A | | 6/1992 | Howell et al. | |
| 5,329,761 A | | 7/1994 | Ablett et al. | |
| 6,606,861 B2 | * | 8/2003 | Snyder | 60/752 |

FOREIGN PATENT DOCUMENTS

| | | |
|---|---|---|
| EP | 0 550 953 | 7/1993 |
| EP | 1 041 344 | 10/2000 |

* cited by examiner

*Primary Examiner*—Ehud Gartenberg
(74) *Attorney, Agent, or Firm*—William S. Andes; Francis L. Conte

(57) ABSTRACT

A combustor baffle includes an annular splashplate having a center mounting tube therein for receiving a carbureted stream. A semi-ferrule is offset both laterally and transversely from the tube, and is open laterally outwardly therefrom. The semi-ferrule cooperates with an adjoining semi-ferrule for defining a port in which a pilot injector or igniter may be mounted.

31 Claims, 4 Drawing Sheets

MULTIPORT DOME BAFFLE

The U.S. Government may have certain rights in this invention in accordance with Contract No. DAAE07-00C-N086 awarded by the Department of the Army.

BACKGROUND OF THE INVENTION

The present invention relates generally to gas turbine engines, and, more specifically, to combustors therein.

Gas turbine engines are configured differently for powering aircraft in flight, propelling vehicles on land, or propelling ships on water. Common to all these engines is a multistage compressor for pressurizing air which is mixed with fuel in a combustor for generating hot combustion gases. The hot gases flow downstream through a high pressure turbine (HPT) which extracts energy therefrom for powering the compressor.

A low pressure turbine (LPT) is disposed downstream from the HPT for extracting additional energy from the combustion gases for producing output work. In the aircraft engine configuration, the LPT powers a fan typically disposed upstream from the compressor. And, in the land vehicle or ship configurations, the LPT powers an external driveshaft joined to a transmission for powering wheels of the vehicle or propellers in the ship.

In the land vehicle configuration of the engine, size and accessibility of the engine are significant design objectives in the limited space typically available in the vehicle. In military vehicles, such as battle tanks, the engine compartment should be minimized in size for maximizing the military usefulness of the vehicle.

Accordingly, the vehicle turbine engine requires compact size while still achieving optimum engine performance and durability, which increase the difficulty of the design thereof. For example, the engine combustor includes outer and inner combustion liners joined together at upstream ends by an annular dome for defining an annular combustion chamber between the liners. Carburetors are mounted in the dome for injecting carbureted fuel and air mixture streams into the combustor for undergoing combustion therein.

Since a gas turbine engine typically operates at tens of thousands of revolutions per minute (RPM), the engine requires suitable starting to achieve stable idle which typically occurs at a majority percent of the maximum rotor speed. Battery powered, electrical starters limit the ability to accelerate the compressor rotor during engine starting and may result in inefficient starting with the generation of undesirable white smoke emissions due to incomplete combustion of the fuel.

Each carburetor typically includes an air swirler, such as a counterrotating air swirler having two rows of swirling vanes for swirling compressor discharge air around fuel injected therein by a center mounted fuel injector. A typical airblast fuel injector is relatively simple and works efficiently with the air swirler at idle speeds and above due to sufficient flowrate and pressure of the compressor discharge air.

However, during starting of the engine the flowrate and pressure of the compressor discharge air only increase as the compressor rotor increases in speed, and this affects the ability to achieve efficient starting performance.

Further complicating the engine design is the requirement for combustor dome baffles corresponding with each of the air swirlers. A typical baffle includes an annular splashplate having a generally trapezoidal configuration which adjoin each other around the circumference of the annular dome. Each splashplate includes a center tube in which the swirler is mounted for receiving air therefrom and fuel from the corresponding injector. The splashplates are specifically configured to protect the structural integrity of the combustor dome from the effects of combustion and for spreading the air-atomized fuel stream both circumferentially and radially into the combustor directly downstream of which the combustion process occurs.

The combustor dome typically includes a multitude of impingement cooling holes extending therethrough for channeling a portion of the compressor discharge air against the forward or upstream sides of baffles for impingement cooling thereof. The row of baffles fully covers the inner surface of the annular dome both circumferentially and radially between the outer and inner liners. Igniters for starting the combustion process are therefore typically located in the combustor outer liner where space permits.

To improve the starting performance of this form of single annular combustor, specifically configured pilot fuel injectors are being developed for use solely during engine starting. However, the full complement of main fuel injectors and their air swirlers must be maintained for efficient operation of the engine at idle speeds and above, which limits the available space for introducing the pilot injectors.

Furthermore, the vehicle configuration of the engine further limits the location in which Line Replaceable Units (LRUs) may be mounted in the engine for subsequent accessibility and removability during a maintenance outage. In particular, the location of the combustion igniters, as well as the pilot injectors, are limited due to the compact configuration of the entire engine for use in the vehicle configuration.

Accordingly, it is desired to provide an improved combustor integrating pilot injectors or igniters or both in the combustor dome having a full complement of main carburetors therein.

BRIEF DESCRIPTION OF THE INVENTION

A combustor baffle includes an annular splashplate having a center mounting tube therein for receiving a carbureted stream. A semi-ferrule is offset both laterally and transversely from the tube, and is open laterally outwardly therefrom. The semi-ferrule cooperates with an adjoining semi-ferrule for defining a port in which a pilot injector or igniter may be mounted.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
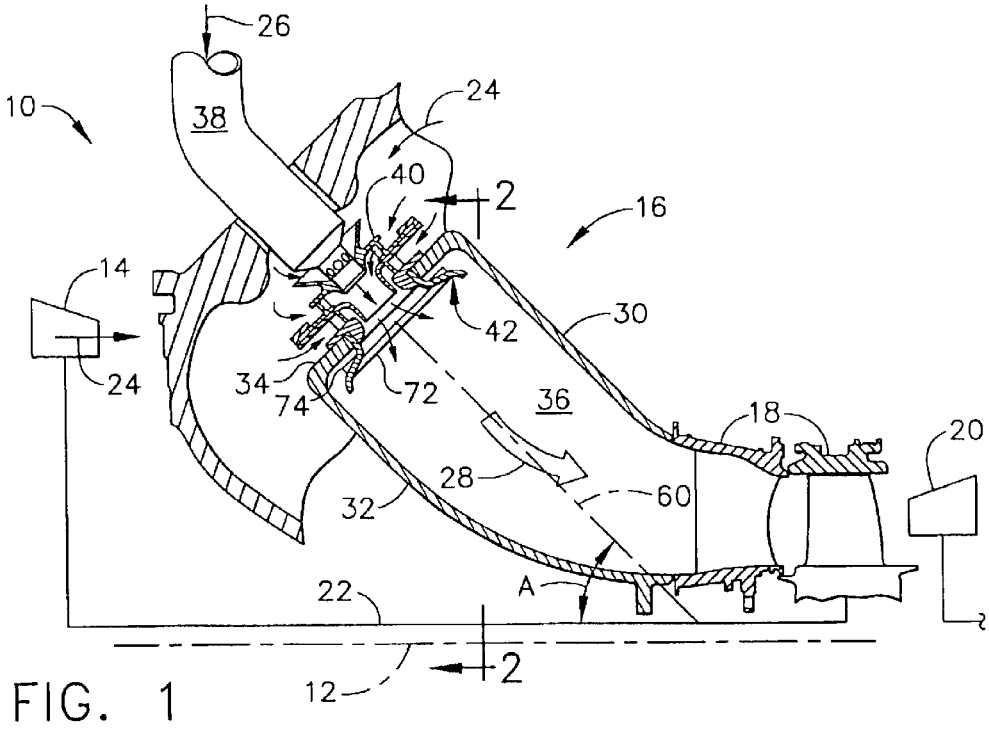
FIG. 1 is an axial sectional view through an annular combustor in a land-based gas turbine engine in accordance with an exemplary embodiment.

Illustrated schematically in FIG. 1 is a portion of a land-based gas turbine engine 10 configured for propelling a vehicle, such as a military tank for example. The engine is axisymmetrical about a longitudinal or axial centerline axis 12 and includes in serial flow communication a multistage compressor 14, annular combustor 16, high pressure turbine 18, and low pressure turbine 20. The HPT 18 is joined to the compressor by a first rotor or shaft 22, and the LPT 20 has a separate driveshaft for providing output power to an external device, such as a transmission in the vehicle.

During operation, ambient air 24 is pressurized in the compressor 14 and discharged therefrom to the combustor. In the combustor, fuel 26 is mixed with the air for generating a carbureted fuel and air mixture stream which is burned for producing combustion gases 28 that are discharged through the nozzle and rotor blades of the HPT 18 which extract energy therefrom for powering the compressor. Additional energy is extracted from the combustion gases in the LPT 20 for powering the vehicle.

The annular combustor 16 is illustrated schematically in FIG. 1 and includes a radially outer combustion liner 30 spaced radially outwardly from a radially inner combustion liner 32 which are both annular and concentric about the centerline axis 12 of the engine. The two liners are joined together at their upstream ends by an annular combustor dome 34, and define an annular combustion chamber 36 therebetween.

The dome is a single annular dome including a single row of carburetors defined by cooperating pairs of main fuel injectors 38 and air swirlers 40. Each swirler 40 is conventional in configuration and includes two rows of radial swirl vanes for swirling the compressor discharge air 24 in two counterrotating streams thereof around the fuel 26 injected from the tip of the injector 38 into the upstream end of the swirler. The injected fuel is thusly finely atomized by the swirling air and discharged in a suitable spray cone or stream of carbureted fuel and air into the combustor. The fuel injector is also conventional in design, and may be a relatively simple airblast fuel injector which relies on the air swirler for atomizing the injected fuel during operation.

Figure 2:
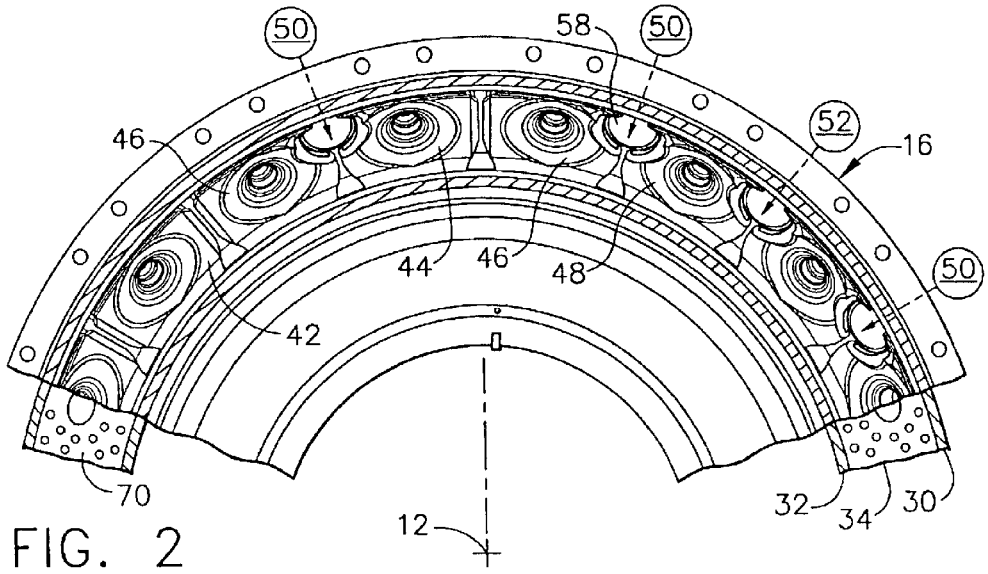
FIG. 2 is an aft-facing-forward radial sectional view of a portion of the combustor illustrated in FIG. 1 and taken along line 2—2.

In order to control the dispersion of the carbureted stream into the combustor and protect the combustor dome from the heat of combustion, each swirler includes a corresponding dome baffle 42,44,46,48, as additionally illustrated in FIG. 2, suitably joined to the dome inside the combustion chamber. A majority of the baffles illustrated in FIG. 2 are identical in configuration and define first baffles 42 which include many conventional features therein. The second, third, and fourth forms of the baffles 44,46,48, respectively, are specifically configured for permitting the installation of one or more pilot fuel injectors 50 and one or more electrical igniters 52 into the common dome 34 as illustrated in FIGS. 3 and 4.

Figure 5:
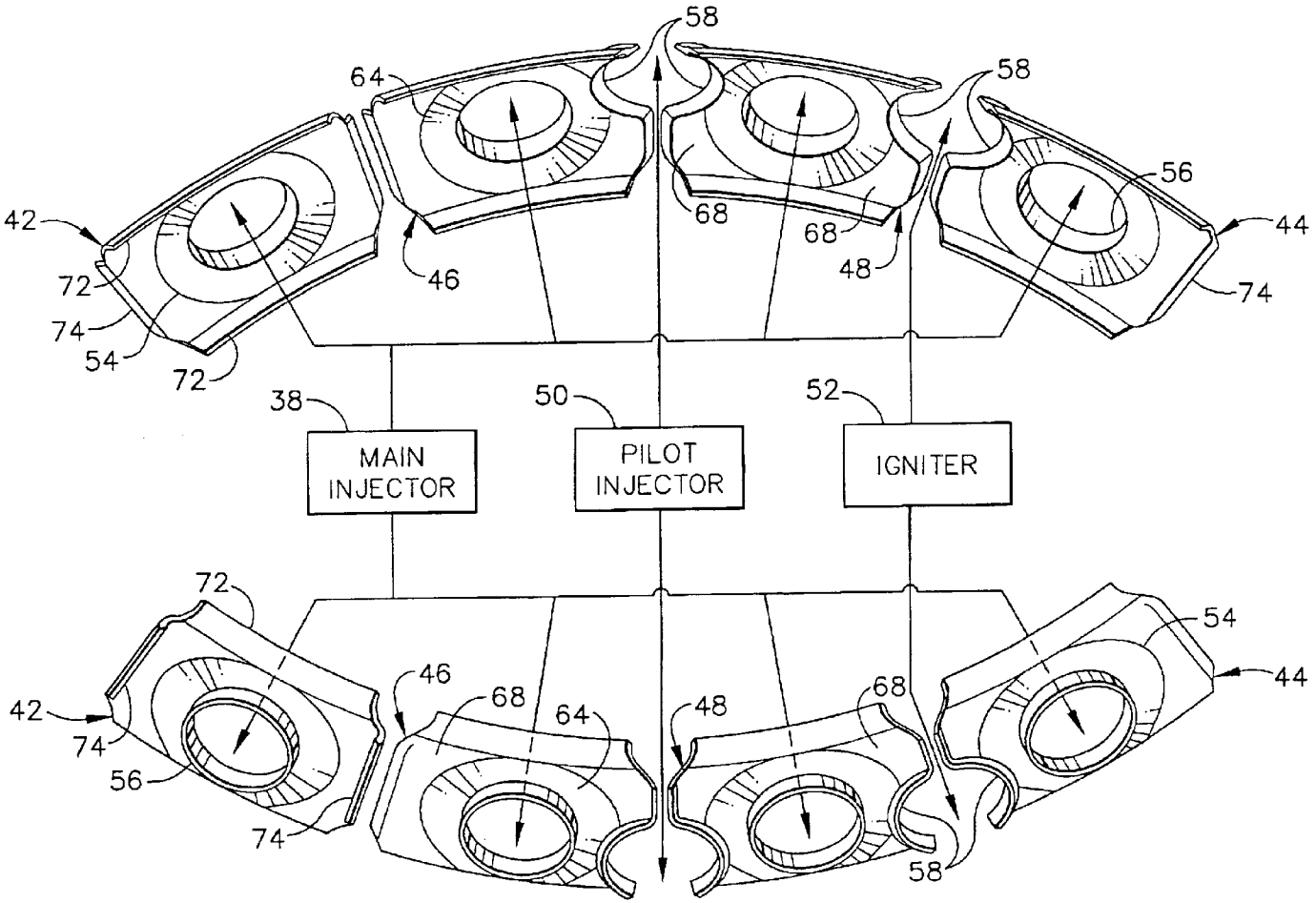
FIG. 5 is an isometric view of four different forms of the baffles used in the combustor illustrated in FIGS. 1–4 for additionally receiving corresponding pilot injectors and igniters through the combustor dome.

More specifically, the four forms of baffles 42–48 are substantially identical to each other except as modified for the introduction of the pilot injectors and igniters into the common single annular dome supporting the row of air swirlers 40 and their corresponding main fuel injectors 38. As shown in FIG. 5, all of the baffles include an annular splashplate 54 having a center mounting sleeve or tube 56 for receiving the carbureted fuel and air stream from the corresponding main injector 38 and air swirler 40. As shown in FIG. 1 the baffle center tube 56 is suitably mounted in a corresponding aperture in the dome 34 in coaxial alignment with the main injector and swirler.

Figure 3:
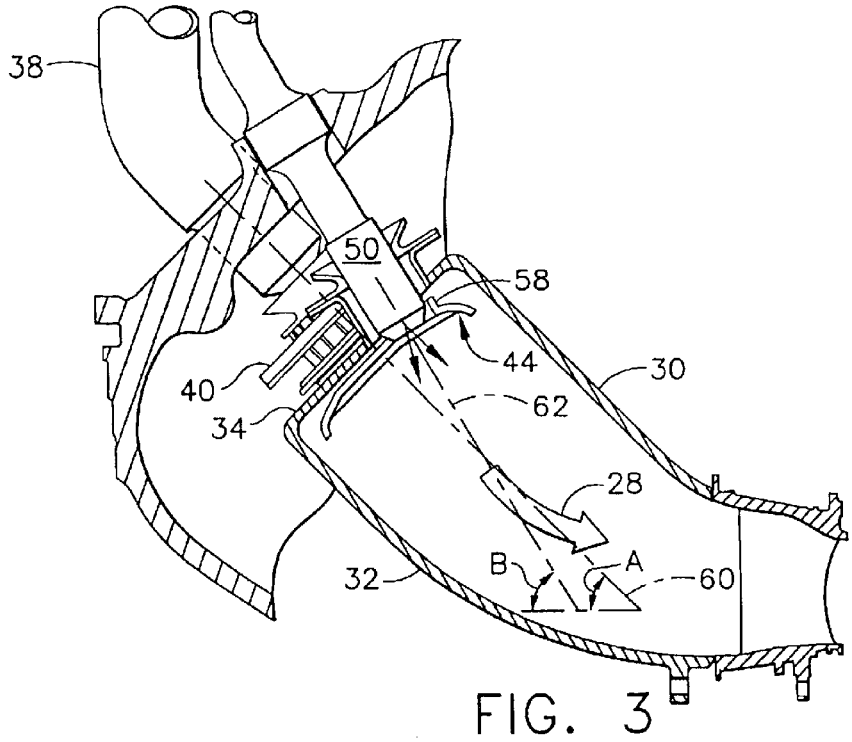
FIG. 3 is an axial sectional view, like FIG. 1, of the combustor along an alternate plane illustrating a pilot fuel injector interspersed between adjacent main carburetors.
Figure 4:
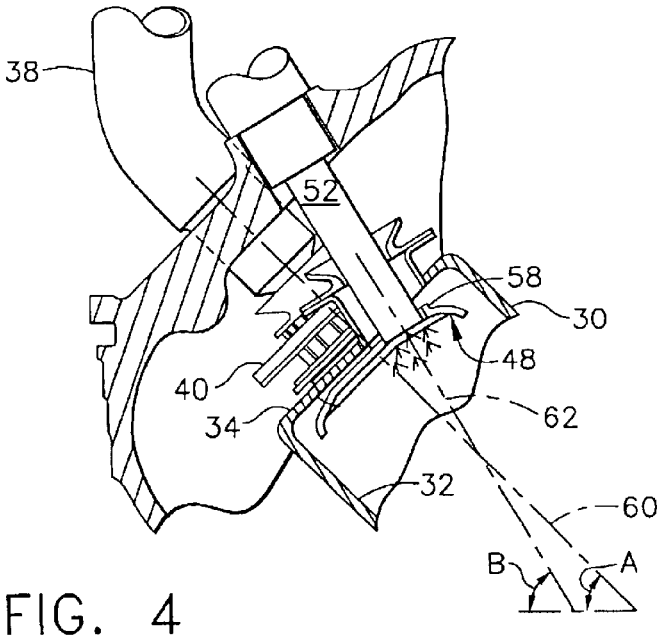
FIG. 4 is an axial sectional view, like FIG. 3, of another plane of the combustor in which an igniter is interspersed between adjacent main carburetors.

In order to introduce the pilot injectors and igniters into the same dome 34, selected adjacent pairs of the baffles 44–48 each include complementary semi-ferrules 58 collectively defining a corresponding opening or port in the baffles aligned with a corresponding aperture in the dome through which the corresponding pilot injector 50 is mounted as illustrated in FIG. 3, and through which the igniter 52 may also be mounted as shown in FIG. 4.

Each semi-ferrule has a semi-circular arcuate configuration as illustrated in FIG. 5, and is open or exposed laterally or circumferentially outwardly from the corresponding edge of the splashplate. In this way, when two baffles are mounted side-by-side in the combustor dome the corresponding semi-ferrules thereof collectively form a circular port for providing access into the combustion chamber by the pilot injectors and igniters.

FIG. 5 illustrates the four common designs of the baffles 42–48, with the first baffle 42 being plain without the semi-ferrules, and the second, third, and fourth baffles having only one or two semi-ferrules as required for introducing the desired number of pilot injectors and igniters at different circumferential positions around the dome. Since the center tubes 56 of each of the full complement of baffles are preferably mounted equidistantly around the circumference of the combustor dome, the individual baffles are designed with maximum surface area for substantially covering the inner surface of the dome for maximizing combustion efficiency and heat-shield protection of the dome during operation.

Accordingly, limited space is available for introducing the semi-ferrules which are therefore offset in each baffle both circumferentially or laterally and radially or transversely from the corresponding center tube. This configuration places the semi-ferrule in corresponding radially outer corner portions of the baffles in a triangular configuration with adjacent center tubes.

Figure 6:
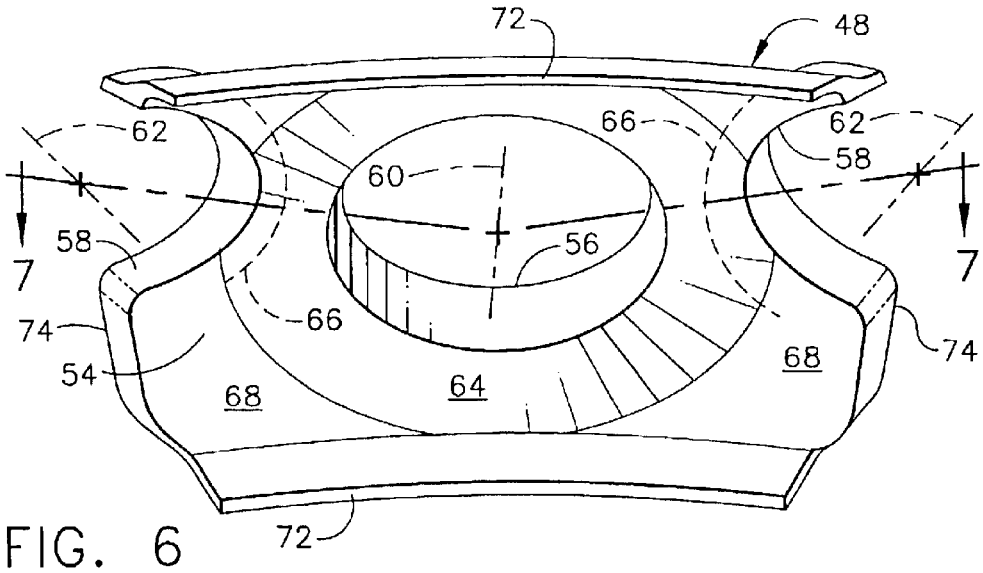
FIG. 6 is an enlarged isometric view of an exemplary one of the dome baffles illustrated in FIG. 5.
Figure 7:
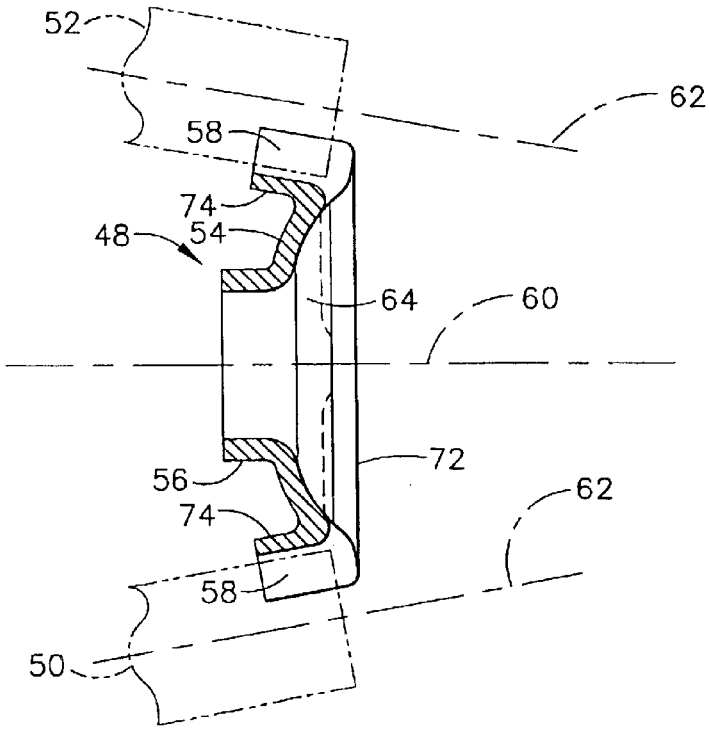
FIG. 7 is a top sectional view through a portion of the baffle illustrated in FIG. 6 and taken along line 7—7.

The annular combustor illustrated in FIG. 1 includes liners which are generally conical and converge aft toward the HPT 18, which configuration inclines the combustor dome aft toward the engine centerline axis 12. Correspondingly, each baffle center tube has a first centerline axis 60 disposed at an acute inclination angle A of about 45 degrees with the engine centerline axis. As shown in FIGS. 6 and 7 the tube centerline axis 60 is disposed normal or perpendicular to the splashplate 54.

In contrast, the pilot injector 50 illustrated in FIG. 3 and the igniter 52 illustrated in FIG. 4 are mounted through the combustor dome at different inclination angles to avoid interference with the main carburetors. Accordingly, the semi-ferrules in which the pilot injectors and igniters are mounted are arcuate or circular about a corresponding second centerline axis 62 having a different inclination angle B, 60 degrees for example, with the engine centerline axis.

The semi-ferrule centerline axis 62 is therefore skewed or oblique with the tube centerline axis 60, with the difference in angular inclination thereof being 15 degrees. The two different centerline axes of the tubes and semi-ferrules require corresponding blending of the baffle splashplates therebetween for enhancing performance of the splashplates during operation for dispersing the carbureted streams, as well as providing suitable back-side impingement cooling of the splashplates themselves.

As illustrated in FIGS. 5 and 6 all of the splashplates 54 have a common design and are preferably conical with a suitably shallow conical flare 64 which extends radially outwardly from the corresponding center tube. The aft face of the conical flare receives the carbureted stream through the center tube and is configured for spreading both radially and circumferentially the carbureted stream with flow attachment thereto and avoiding flow separation therefrom. The flare therefore provides wide dispersion of the stream around the combustor dome from the row of baffles mounted therein.

As illustrated schematically in FIG. 6, the conical flare 64 is locally blended with the corresponding semi-ferrule 58 in a suitable blend region 66 for preventing impingement of the carbureted stream against the tips of the pilot injectors or igniters mounted in the semi-ferrules during operation. As illustrated in FIGS. 3 and 4, the distal ends or tips of the pilot injectors 50 and igniters 52 are preferably mounted substantially flush or slightly recessed from the aft surface of the corresponding center tubes. In this way, the possibility of trapping raw fuel in the semi-ferrules is reduced, and the injector and igniter tips do not extend or protrude aft of the baffles into the combustion flame located immediately downstream therefrom.

As shown in FIGS. 5 and 6, the splashplates of all the baffles also commonly include pairs of integral side shields or lands 68 extending laterally outwardly from opposite circumferential sides of the splashplates. The shields are integral with their corresponding conical flares for defining generally trapezoidal splashplates.

The left and right shields in each of the baffles are preferably portions of a common conical surface having a different conical flare angle or inclination from the tube centerline axis 60 than that of the conical flare 64. For example, the inclination angle of the shield 68 is preferably slightly less than that of the conical flare 64 so that the shields may better match the orientation of the combustor dome 34 illustrated in FIGS. 1 and 2 for enhancing back-side impingement cooling of the baffles.

For example, FIG. 2 illustrates a multitude of impingement cooling holes 70 in the combustor dome 34 through which a portion of the compressor discharge air is channeled for impingement cooling the upstream or forward surface of the splashplates including the conical flare and side shields thereof. The conical flare 64 is specifically configured for dispersing the carbureted stream into the combustor for enhanced combustion performance, whereas the surrounding side shields 68 are differently configured for enhancing impingement cooling of the splashplate.

As shown in FIGS. 5 and 6 the complementary semi-ferrules 58 extend through corresponding ones of the side shields to adjoin a local region of the corresponding conical flares 64.

All of the baffles illustrated in FIG. 5 also include corresponding pairs of wings or lips 72 which extend laterally along opposite transverse edges of the splashplates. Correspondingly, all of the baffles also include a pair of rims or dams 74 extending transversely along opposite lateral edges of the respective splashplates. The dams 74 also extend along the individual semi-ferrules 58.

As shown in FIG. 5, the center tube 56 and dams 74 of each of the baffles extend obliquely forward from each splashplate, whereas the lips 72 extend oppositely therefrom and obliquely aft from the splashplate. This is also illustrated in FIG. 1.

The baffle lips provide curved transitions between the baffles and outer and inner liners for discharging the spent impingement cooling air into the combustor in a conventional manner. The dams 74 extend forwardly towards the combustor dome for blocking circumferential distribution of the impingement air behind each baffle for promoting its discharge over the radially outer and inner lips 72.

The lips and dams may be conventionally configured and form integral parts of the individual baffles along with the splashplate and center tube thereof typically manufactured in a common casting using a suitable high-temperature strength superalloy metal.

Each baffle is preferably formed of a single crystal metal casting for enhancing its strength in the hostile, high temperature environment of the combustor. As indicated above, the baffles may be substantially identical to each other except as locally modified for the introduction of the semi-ferrules 58, and the suitable blending thereof into the splashplates for maximizing performance of the main injectors, pilot injectors, and electrical igniters in the limited space provided in the single annular dome.

As shown in FIGS. 5 and 6 each of the semi-ferrules 58 adjoins the radially outer lip 72 of each baffle in either the left or right side shield 68 as required for forming the corresponding port with an adjacent semi-ferrule. As shown in FIG. 6, the corresponding side shield 68 is also locally blended in an extension of the blend region 66 with the outer lip 72 and corresponding semi-ferrule to reduce or avoid local fuel rich concentration of the carbureted stream in this region.

As indicated above, the splashplate 54 provides several functions in the normal operation of the combustor, including the wide dispersion of the carbureted stream with suitable flow attachment along the aft face of the conical flare 64. The splashplate 54 is imperforate around the center tube 56 and provides a continuous surface to the radially outer lip 72 and the circumferentially outer dams 74, and terminates at the locally introduced semi-ferrule 58. Since the semi-ferrules interrupt the otherwise continuous surface contour of the splashplate including the conical flare and side shields, the flare and shields are suitably blended with the semi-ferrule to accommodate the difference in angular inclination of the centerline axes 60,62 of the splashplate itself and the semi-ferrule 58.

As indicated above, the blend region 66 is provided to prevent impingement of the dispersed carbureted stream against the tips of the pilot injectors or igniters which may be recessed slightly in the semi-ferrules. And, the blend region 66 is also provided near the outer lip 72 where it meets the semi-ferrule to reduce the likelihood of local fuel rich concentration of the dispersed carbureted stream.

In order to introduce at least one pilot injector or electrical igniter into the common annular dome 34 illustrated in FIG. 2, two adjacent baffles must be modified for introducing the complementary semi-ferrules 58. As shown in FIG. 5, the corresponding splashplate 54 of these modified baffles may therefore each include a single semi-ferrule 58 adjoining the outer lip 72. For example, the second baffle 44 includes a single semi-ferrule 58 in the left shield 68 along the left circumferential edge of the splashplate.

Correspondingly, the third baffle 46 includes a single semi-ferrule 58 disposed in the right side shield 68 along the right circumferential edge of the splashplate. As shown in FIG. 2, the second and third baffles 44,46 may be disposed in the dome adjacent to each other for defining between the complementary semi-ferrules thereof a suitable port for receiving one of the pilot injectors 50.

Whereas the second and third baffles 44,46 are basically mirror images of each other, the fourth baffle 48 illustrated in FIGS. 5 and 6 includes an opposite pair of the semi-ferrules 58 in the common splashplate thereof, which adjoin the outer lip 72 in both left and right side shields 68.

This double ferrule form of the fourth baffle 48 may be used as illustrated in FIG. 2 for providing two corresponding access ports on opposite circumferential sides of a single main carburetor. A second baffle 44 may adjoin the fourth baffle 48 on the right side thereof to align together the corresponding left and right semi-ferrules 58 thereof in one port for receiving either a pilot injector 50 or the igniter 52. A third baffle 46 may adjoin the fourth baffle 48 on the opposite left side thereof to align together the left and right semi-ferrules thereof in another port for receiving a pilot injector or igniter.

In this way, the four configurations of the baffles 42–48 may be used to advantage for locally modifying the circumferential symmetry of the combustor dome for additionally introducing the pilot injectors and igniters with the main injectors. A majority of the baffles comprise the first baffles 42 which are devoid of the semi-ferrules in the left and right shields thereof. And, the second and third baffles 44,46 may be used together for defining a corresponding port between the semi-ferrules thereof, or may be used with the double-ferrule fourth baffle 48 for providing corresponding ports on opposite sides thereof.

As shown in FIG. 2, one pair of the second and third baffles 44,46 may adjoin each other to align together the corresponding left and right semi-ferrules thereof in one port. Additional second and third baffles 44,46 may be used with an adjoining fourth baffle 48 to align together the corresponding left and right semi-ferrules 58 for defining two additional ports.

And, the left and right semi-ferrules 58 are disposed radially outwardly from the corresponding center tubes 56 for permitting the corresponding pilot injectors and igniters to be mounted around the radially outer perimeter of the combustor dome for ready accessibility.

In this way, any suitable number of additional ports may be defined by specifically introducing the semi-ferrules 58 where desired. In the exemplary embodiment illustrated in FIG. 2, multiple pilot injectors 50 and multiple igniters 52 may be closely grouped together in a single quadrant of the combustor dome for improving starting performance of the combustor during operation.

Accordingly, by the simple introduction of specifically located and specifically blended semi-ferrules 58 in the otherwise identical combustor dome baffles, corresponding ports may be conveniently located for the introduction of the pilot injectors 50 and electrical igniters 52 in the common, single annular dome of the combustor. The main carburetors, including their air swirlers and main fuel injectors, maintain their equal angular spacing around the combustor dome for maximizing engine performance, with the pilot injectors and igniters being conveniently located between corresponding ones of the main carburetors.

All the baffles share a common design for reducing parts count. The semi-ferrules 58 create equal-size ports for the pilot injectors 50 and igniters 52. And, only three different forms of the semi-ferrule baffles 44–48 are required for closely introducing together the respective ports defined thereby. Accordingly, only four different baffle designs are required, all sharing a common configuration, except for the specific introduction of the semi-ferrules therein.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A combustor baffle comprising:

a conical splashplate having a center mounting tube for receiving a carbureted stream;

a semi-ferrule offset both laterally and transversely from said tube, and being open laterally outwardly therefrom; and said tube has a first centerline axis disposed normal to said splashplate, and said semi-ferrule is arcuate about a second centerline axis skewed obliquely with said first centerline axis.

2. A baffle according to claim 1 wherein said splashplate further comprises a pair of shields extending laterally outwardly therefrom with a different angle of inclination from said first axis, and said semi-ferrule extends through one of said shields to adjoin said conical flare.

3. A baffle according to claim 2 further comprising:

a pair of lips extending laterally along opposite transverse edges of said splashplate; and a pair of dams extending transversely along opposite lateral edges of said splashplate, and along said semi-ferrule.

4. A baffle according to claim 3 wherein:

said splashplate includes a conical flare extending radially outwardly from said center tube for spreading laterally said stream, and said flare is locally blended with said semi-ferrule; and said semi-ferrule adjoins one of said lips in one of said shields, and said one shield is locally blended with said one lip and semi-ferrule to reduce local fuel rich concentration of said stream thereat.

5. A baffle according to claim 4 wherein said shields have a common conical flare angle.

6. A baffle according to claim 5 wherein said splashplate is imperforate around said center tube.

7. A baffle according to claim 6 wherein said splashplate includes a single semi-ferrule adjoining an outer one of said lips.

8. A baffle according to claim 7 wherein said semi-ferrule is disposed in a left one of said shields.

9. A baffle according to claim 7 wherein said semi-ferrule is disposed in a right one of said shields.

10. A baffle according to claim 6 wherein said splashplate includes a pair of said semi-ferrules adjoining an outer one of said lips in both left and right ones of said shields.

11. A combustor baffle comprising:

an annular splashplate having a center mounting tube for receiving a carbureted stream; and a semi-ferrule offset both laterally and transversely from said tube, and being open laterally outwardly therefrom.

12. A baffle according to claim 11 wherein said tube has a first centerline axis disposed normal to said splashplate, and said semi-ferrule is arcuate about a second centerline axis skewed obliquely with said first centerline axis.

13. A baffle according to claim 12 wherein said splashplate includes a conical flare extending radially outwardly from said center tube for spreading laterally said stream, and said flare is locally blended with said semi-ferrule.

14. A baffle according to claim 13 wherein said splashplate further comprises a pair of shields extending laterally outwardly therefrom with a different angle of inclination from said first axis, and said semi-ferrule extends through one of said shields to adjoin said conical flare.

15. A baffle according to claim 14 wherein said shield has a common conical flare angle.

16. A baffle according to claim 14 further comprising:

a pair of lips extending laterally along opposite transverse edges of said splashplate; and a pair of dams extending transversely along opposite lateral edges of said splashplate, and along said semi-ferrule.

17. A baffle according to claim 16 wherein said center tube and dams extend obliquely forward from said splashplate, and said lips extend oppositely therefrom and obliquely aft from said splashplate.

18. A baffle according to claim 16 wherein said semi-ferrule adjoins one of said lips in one of said shields, and said one shield is locally blended with said one lip and semi-ferrule to reduce local fuel rich concentration of said stream thereat.

19. A baffle according to claim 16 wherein said splashplate is imperforate around said center tube.

20. A baffle according to claim 16 wherein said splashplate includes a single semi-ferrule adjoining an outer one of said lips.

21. A baffle according to claim 20 wherein said semi-ferrule is disposed in a left one of said shields.

22. A baffle according to claim 20 wherein said semi-ferrule is disposed in a right one of said shields.

23. A baffle according to claim 16 wherein said splashplate includes a pair of said semi-ferrules adjoining an outer one of said lips in both left and right ones of said shields.

24. A combustor comprising:

radially outer and inner annular liners joined together at upstream ends to an annular dome to define an annular combustion chamber therebetween;

a row of baffles joined to said dome inside said combustion chamber by corresponding mounting tubes extending through corresponding apertures in said dome;

each of said baffles including an annular splashplate surrounding a corresponding one of said tubes for receiving a carbureted stream; and an adjoining pair of said baffles having complementary semi-ferrules collectively defining a port between adjacent ones of said tubes, with said semi-ferrules being offset both circumferentially and radially from said adjacent tubes, and being open circumferentially outwardly toward each other.

25. A combustor according to claim 24 wherein each of said baffle tubes has a first centerline axis disposed normal to said splashplate, and said semi-ferrule thereof is arcuate about a second centerline axis skewed obliquely with said first centerline axis.

26. A combustor according to claim 25 wherein said baffles comprise:

first baffles without said semi-ferrules;

a second baffle with said semi-ferrule disposed on a left edge thereof; and a third baffle with said semi-ferrule disposed on a right edge thereof.

27. A combustor according to claim 26 wherein each of said splashplates includes a conical flare extending radially outwardly from said center tube for spreading circumferentially said stream, and said flare is locally blended with said semi-ferrule.

28. A combustor according to claim 27 wherein:

each of said splashplates further comprises a pair of left and right shields extending circumferentially outwardly therefrom with a different angle of inclination from said first centerline axis;

said second baffle includes said semi-ferrule in said left shield;

said third baffle includes said semi-ferrule in said right shield; and said first baffle is devoid of said semi-ferrules in said left and right shields thereof.

29. A combustor according to claim 28 wherein:

said baffles further comprise a fourth baffle having a semi-ferrule in said left shield, and an opposite semi-ferrule in said right shield thereof;

said second baffle adjoins said fourth baffle on the right side thereof to align together said left and right semi-ferrules thereof in one port; and said third baffle adjoins said fourth baffle on the left side thereof to align together said right and left semi-ferrules thereof in a second port.

30. A combustor according to claim 29 wherein another pair of said second and third baffles adjoin each other to align together said left and right semi-ferrules thereof in another port.

31. A combustor according to claim 28 wherein said left and right semi-ferrules are disposed radially outwardly of said tubes.

* * * * *